US011926458B1

(12) United States Patent
L'Heureux et al.

(10) Patent No.: US 11,926,458 B1
(45) Date of Patent: Mar. 12, 2024

(54) CONTAINER CARRIER

(71) Applicants: Kevin Alan L'Heureux, San Marcos, CA (US); Keith James Elliott, Santa Clarita, CA (US); Wayne Gebhardt, Cheney, WA (US)

(72) Inventors: Kevin Alan L'Heureux, San Marcos, CA (US); Keith James Elliott, Santa Clarita, CA (US); Wayne Gebhardt, Cheney, WA (US)

(73) Assignee: FISHBONE PACKAGING INC., San marcos, CA (US)

( * ) Notice: Subject to any disclaimer, the term of this patent is extended or adjusted under 35 U.S.C. 154(b) by 0 days.

(21) Appl. No.: 18/130,366

(22) Filed: Apr. 3, 2023

Related U.S. Application Data

(63) Continuation-in-part of application No. 17/903,760, filed on Sep. 6, 2022, and a continuation-in-part of application No. 29/772,724, filed on Mar. 3, 2021, now Pat. No. Des. 982,457, and a continuation-in-part of application No. 16/950,804, filed on Nov. 17, 2020, now Pat. No. 11,511,895.

(60) Provisional application No. 63/241,061, filed on Sep. 6, 2021, provisional application No. 63/093,856, filed on Oct. 20, 2020, provisional application No. 62/936,744, filed on Nov. 18, 2019.

(51) Int. Cl.

| | |
|---|---|
| ***B65B 17/02*** | (2006.01) |
| ***B65D 5/468*** | (2006.01) |
| ***B65D 71/50*** | (2006.01) |

(52) U.S. Cl.
CPC ..... *B65D 71/50* (2013.01); *B65B 17/025* (2013.01); *B65D 5/4608* (2013.01)

(58) Field of Classification Search
USPC ..... 53/398
See application file for complete search history.

(56) References Cited

U.S. PATENT DOCUMENTS 3,556,386 A * 1/1971 Ganz ..... B65B 61/207 206/196
2008/0135423 A1* 6/2008 Oliveira ..... B65D 71/46 229/120.32

FOREIGN PATENT DOCUMENTS

WO WO-2008089169 A2 * 7/2008 ..... B31B 1/28

* cited by examiner

*Primary Examiner* — Chinyere J Rushing-Tucker
(74) *Attorney, Agent, or Firm* — QuickPatents; Kevin Prince

(57) ABSTRACT

A carrier for a plurality of containers includes an upper web having a plurality of upper web apertures, each for receiving a chime and a neck of one of the containers therethrough. Each upper web aperture has a plurality of tabs formed at an inside edge thereof. Each tab is configured for bending upward when contacting the chime of one of the containers. A lower web has a plurality of lower web apertures, each for receiving a body of one of the containers therethrough. A side web connects the upper web with the lower web, and may be formed together with the upper web and the lower web as a single piece, or into two separate portions that may be adhered or otherwise fastened together.

14 Claims, 9 Drawing Sheets

CONTAINER CARRIER

CROSS-REFERENCE TO RELATED APPLICATIONS

This application is a Continuation-in-Part of US Design Patent Application 29/772,724, filed on Mar. 3, 2021, and is also a Continuation-in-Part of U.S. Utility patent Ser. No. 17/903,760, filed on Sep. 6, 2022, which claimed the benefit of U.S. Provisional Patent Application 63/241,061 filed on Sep. 6, 2021, and was further a Continuation-in-Part of U.S. Utility patent application Ser. No. 16/950,804, filed on Nov. 17, 2020, which itself claimed the benefit of U.S. Provisional Patent Applications 62/936,744 filed on Nov. 19, 2019 and 63/093,856 filed on Oct. 20, 2020, all incorporated herein by reference.

STATEMENT REGARDING FEDERALLY SPONSORED RESEARCH AND DEVELOPMENT

Not Applicable.

FIELD OF THE INVENTION

This invention relates to container packages, and more particularly to a paper-based C-shaped container carrier.

BACKGROUND

The term "carrier" as used herein, refers to any carrying means that, in combination with a container, allows for the transport of the container or group or plurality of containers. The term "container" as used herein, refers to any container including a neck or chime portion, or otherwise amenable attachment point on the container that's adapted for receiving a carrier having a container-engaging opening. The container may hold a liquid, for example, beverage and/or non-beverage the like. Also referred as vessel canister, can, jar, bottle, or another sealed receptacle. Common containers could be made from metal, glass, plastic, molded pulp, aluminum, or paper.

The term "raised platform carrier" refers to the vertical tab aperture designed device which fits under the neck/collar on the chimes or attachment points on containers and when applied elevates the container attachment point above the planar level of the remainder of the carrier material surface.

The term "tab" refers to specifically shaped and arranged mechanisms inside the apertures of the raised platform carrier that once bent/raised/turned vertically connect with the chime/curl/flange/hem of a container to temporarily couple the raised platform carrier with the cans/bottles/containers until it is forcibly removed.

The term "neck" on a container refers to the collar on a can, bottle, or other container type. The portion of the collar that's close to the neck of the bottle produces a ledge. This ledge will support the raised platform carrier device.

The term "lid" refers to the "end closure for a container" which is placed onto the can or bottle neck and sealed and/or "seemed" after the filling process is completed. The can lid has an "openable or removable component" which the user manipulates to access the product contained inside.

The terms "chime," "curl," "flange," or "hem" is the area of the container that is turned in on itself to provide a safe finished curved, flat, or otherwise appropriately shaped edge. This chime provides a ledge that will support the raised platform carrier.

The term "clip" is any mechanism or device that retains or sandwiches via mechanical force, pressure, suction, adhesive, or with other retaining mechanisms, the edges, or corners of a raised platform carrier to hold it in a flat position while it is mated/adhered/attached to containers. This retaining mechanism helps the raised platform carrier to be coupled to containers and then uncoupled for consumers to use.

There are many types of multi-packing carriers in the beverage and non-beverage container industry. The beverage and non-beverage carriers are often circular plastic ring carriers, commonly known as six pack rings, which unitize a plurality of like sized containers into a single package. Some circular plastic rings or multi-packaging rings are injected molded. These types of carriers are more commonly fabricated from flat, thin gauge sheets of plastic and attach to the container at a single point or surface such as the container neck or body. Circular plastic ring carrying devices such as the low-density polyethylene (LDPE), High density polyethylene (HDPE) and other circular plastic type carriers are common in our marketplace and homes, yet they are loathed by manufacturers and consumers.

Please note, the plastic rings come in a variety of configurations, dimensions, and shapes such as square, circular, triangular and other shapes that once stretched comply to the container shape which it is attached. There are other types of multi-packaging systems to carry beverages and non-beverages containers. Some examples are paper cartons, corrugated containers, boxes, wax boxes, folding cartons, beverage baskets, molded pulp, plastic, or other materials commonly used.

Circular plastic rings and multi-packaging carriers that package a plurality of containers by their neck, chimes or container body and allow the containers to be carried are well known.

These circular plastic rings and multi-packaging carriers are commonly used to secure cans or containers through the manufacturing, supply, inventory, distribution, retail and consumer use chain. The most common use of these circular plastic ring carriers and multi-packaging carriers are in supermarkets, convenience stores, food delivery industry and other retail locations.

This common circular plastic ring multi-packaging systems often secure containers of soda, beer, juice, water, energy drinks and other liquids and is typically manufactured for a variety of containers and various plural configurations such as two, four, six, eight, etc. in-line configurations such as two, three etc. The low-density polyethylene (LDPE) carrying devices and the high-density polyethylene (HDPE) carrying devices currently being manufactured are an inherent danger to the environment and a frustration point to manufactures and customers. These circular plastic ring multi-packaging systems are clogging oceans and landfills with its waste. Wildlife animals are often severely injured or killed due to entrapment or ingestion of the circular plastic rings. Furthermore, the plastic material throughout time will break down into microscopic pieces which often gets eaten by ocean and land animals making their way through the food chain as well as into our drinking water. Traditional circular plastic ring beverage carrying devices tend to become malformed and lose elasticity when exposed to light due to its photo-degradability (UV exposure) to heat and other elements, often causing containers to dislodge from the caring device and causing product damage or loss. These circular plastic rings have caused a major environmental concern and this type of packaging is becoming less desirable or out-right banned from the marketplace by municipalities.

Manufacturers, retailers, and consumers are looking for multi-packaging carrier solutions that are leaving a smaller carbon footprint. Using less materials or materials that are biodegradable or recyclable causes less damage to the environment and would be preferable. Packaging which reduces the environmental impact and ecological footprint is preferred as well.

This has caused retail businesses and manufacturers to look for alternative sustainable, biodegradable, recyclable, and reduced material packaging solutions for carrying beverages and non-beverages containers. There is a need for an apparatus (applicator) and method (process) for efficiently and accurately applying a biodegradable, recyclable carrier and/or using less material for carriers for containers.

Container applications described here include those for the common aluminum food and beverage cans found in CSD's, beer, wine, juice, water, etc. including but not limited to, "slim", "sleek" 200/202, 204.5, 207.5, 209, 211 and 307 style cans as known in the industry which are mated to a variety of can "ends" during the filling and sealing process. Ends are commonly 200, 202, 204, 206, 300, Ring-Pull ends, 360 End, Resealable ends 38 mm threaded closure and other dimensional ends or a combination thereof used in the industry, PET and glass bottles for soda, juice, water, milk, powder, metal food cans, injection molded, HDPE, LDPE, and other container types.

Many of these are found in institutional and retail food, beverage, wet and dry goods, household goods, automotive, industrial or a variety of other market segments. These solutions may also be applied to uncommonly shaped or sized containers, newly developed and emerging container technology types such as paper-based or other highly degradable container types with a neck engaging attachment point.

Common so-called 202/211 drink can profiles consist of a major diameter and minor diameter (body diameter and end diameter) with the major diameter being approximately 2.6" and a minor diameter being approximately 2.06" with an approximate differential of 0.54 in overall diameter and 0.27" radius. Such a container can accommodate a single-layer, raised aperture carrier design. These dimensions allow room for the carrier apertures to capture the containers while also allowing for "body-to-body" nesting pattern of the primary containers below the carrier once applied.

Recently, newer, more contemporary container designs, or profiles, have become popular, which has created new packaging challenges for multi-pack carrying devices. These container types are known in the industry as "slim" 200/202 (2.08" major dia. and 2.0" minor dia.) and "sleek" 202/204 (2.26" major dia. and 2.06" minor dia.), or other similar moniker depending on manufacturer. They look visually similar to the common observer with similar dimensions and constraints. The 202/211 can has a substantial difference between the major and minor diameters of 0.54" to accommodate carrier/aperture application. The slim, sleek and similar modern container designs, that have major and minor diameters that are close to the same size, do not present the space required to create the complete individual apertures and tooth/flange array necessary to capture the container neck and create a plurality of nested containers. In order to solve for this, the container attachment points must be moved away from each other in order to regain the necessary room around each aperture for attachment. With this widened spacing new challenges are created in keeping the containers vertically positioned and rigid within the pack, without the pack of containers collapsing into itself, all while keeping a small overall pack profile.

Our invention is a raised platform carrier solution that creates the required space necessary for an upper web aperture with a variety of engagement parameters and adds a secondary friction fit, lower web which further locks the containers into a rigid array while eliminating tilting within the pack and keeping all of the containers vertical. Once attached, a side web component can be utilized for brand logos, indicia, or marketing print while further creating a rigid pack format, greatly reducing overall material use in competitive solutions such as cartons and overwraps.

Therefore, there is a need for a recyclable carrier device that can hold a wide variety of different types of containers at the neck, chime, and body of the container. Such a needed invention would provide for receiving a variety of container sizes, and would include a side panel for advertising brand or other information thereon. Such a needed carrier would hold the containers firmly together and would be relatively easy to apply to the containers. The present invention accomplishes these objectives.

SUMMARY OF THE INVENTION

This invention is also designed to create a similar overall pack formation for those containers where the relationship of diameters do not fit the standard neck engaging carrier constraints and are otherwise unable to be fit to a clip-style carrier. This solution also retains the generally accepted plurality format.

The 1-piece and 2-piece "C-clip" carrier allows for container spacing requirements for container neck engagement of between 4 to 6 millimeters typically between apertures with 4 mm being considered as the minimum gap when operating with slim/sleek can dimensions as an example. In theory there is no maximum gap that could be developed in-between apertures or body diameters.

Another benefit of the inter-container spacing which is produced by our raised platform carrier is that it allows the carrier material on both the upper and lower support components to act as a "buffer zone" for each of the grouped primary packaging containers such as with aluminum bottles with a 38/211 profile, insuring that containers do not touch or directly interact during packaging, distribution or retail sale in any way that would allow them to dent, crush, scratch or otherwise mar one-another or any other part of the secondary packaging devices. This feature can reduce or eliminate the amount of damaged and unsaleable product in the marketplace which is a desired effect for the manufacturer as it can save additional costs and returns. This spacing is beneficial in both retail and direct to consumer shipping among others. Additionally, the side web creates a marketing panel which allows for logos, QR codes, indicia or other printed material desired by the manufacturer.

The present device is a carrier for a plurality of containers of the type having a body, a neck, and a lid with a chime. The chimes of each container are aligned in a common horizontal plane. The present invention engages three areas of each container, namely the body, neck, and the chime, for increased pack security, retention, and reliability. This invention is of a neck-engaging, raised platform "clip-style" carrier with an additional side web section and lower web section allowing for packaging of newer-style, increasingly prevalent container shapes and constraints required therein. These are seen in but not limited to "slim", "sleek" beverage cans as well as 38/211 aluminum bottles and other proportioned containers where end-to-body ratios are variable.

An upper web has an upper web top surface, an upper web bottom surface, at least one upper web peripheral edge, and a plurality of upper web apertures, each for receiving the chime and the neck of one of the containers therethrough. Each upper web aperture has a plurality of tabs formed at an inside edge thereof. Each tab is configured for bending upward when contacting the chime of one of the containers.

A lower web has a lower web top surface, a lower web bottom surface, at least one lower web peripheral edge, and a plurality of lower web apertures, each for receiving the body of one of the containers therethrough.

A side web connects the upper web with the lower web between at least one each of the upper web peripheral edges and the lower web peripheral edges. The side web includes an outer surface, an inner surface, and at least one side web peripheral edge.

Preferably, the upper web, side web, and lower web are made with a paper board, cardstock, or other sustainable or recycled material. The upper web, lower web, and side web may all be formed from a common flat cardstock material, or may be formed into two portions that are adhered or otherwise mutually attached as discussed below.

As such, with the containers aligned with the lower web apertures of the lower web, the carrier is formed into a C-shape and the lower web is pressed onto the containers uniformly so that one container traverses each lower web aperture. Each lower web aperture thereby engages the body of one of the containers.

Next, the upper web is pressed onto the containers uniformly, the tabs of each of the upper web apertures of the carrier deforming upwardly substantially simultaneously to pass the chimes of the containers. Each tab abuts a lower edge of the chime of one of the containers and engages the neck of the container. The upper web and the lower web thereby hold each container at the body, the neck, and the chime thereof.

In preferred embodiments, each lower aperture includes a plurality of notches formed on an inside circumferential edge of the aperture. A plurality of lower web aperture tabs are defined between the notches. The lower web apertures are sized to snuggly fit around the body of the container, with the lower web aperture tabs being slightly deformed or bent to receive each container.

In some embodiments the side web is comprised of an upper side web fixed with the upper web, and a lower side web fixed with the lower web. The upper side web and the lower side web are mutually attachable, such as with adhesive, tab-and-slot mechanical fasteners, or the like. In such embodiments having the upper side web and the lower side web, in use the lower web is pressed onto the containers uniformly so that one container traverses each lower web aperture. Each lower web aperture thereby engages the body of one of the containers.

Next, the upper web is pressed onto the containers uniformly, the tabs of each of the upper web apertures of the carrier deforming upwardly substantially simultaneously to pass the chimes of the containers. Each tab abuts a lower edge of the chime of one of the containers and engages the neck of the container.

Next, the upper side web and the lower side web are mutually affixed, either with the adhesive, the connection tabs and the slots, or with other mechanical fasteners such that the upper web and the lower web hold each container at the body, the neck, and the chime thereof. In some embodiments the inner surface of the side web is adhered to the body of at least two of the containers to further hold the containers in a stable, coherent pack.

The present invention is a recyclable carrier device that can hold a wide variety of different types of containers at the neck, chime, and body of the container. The present invention provides for receiving a variety of container sizes, and includes a side panel for advertising brand or other information thereon. The carrier of the present invention holds the containers firmly together and is relatively easy to apply to the containers. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
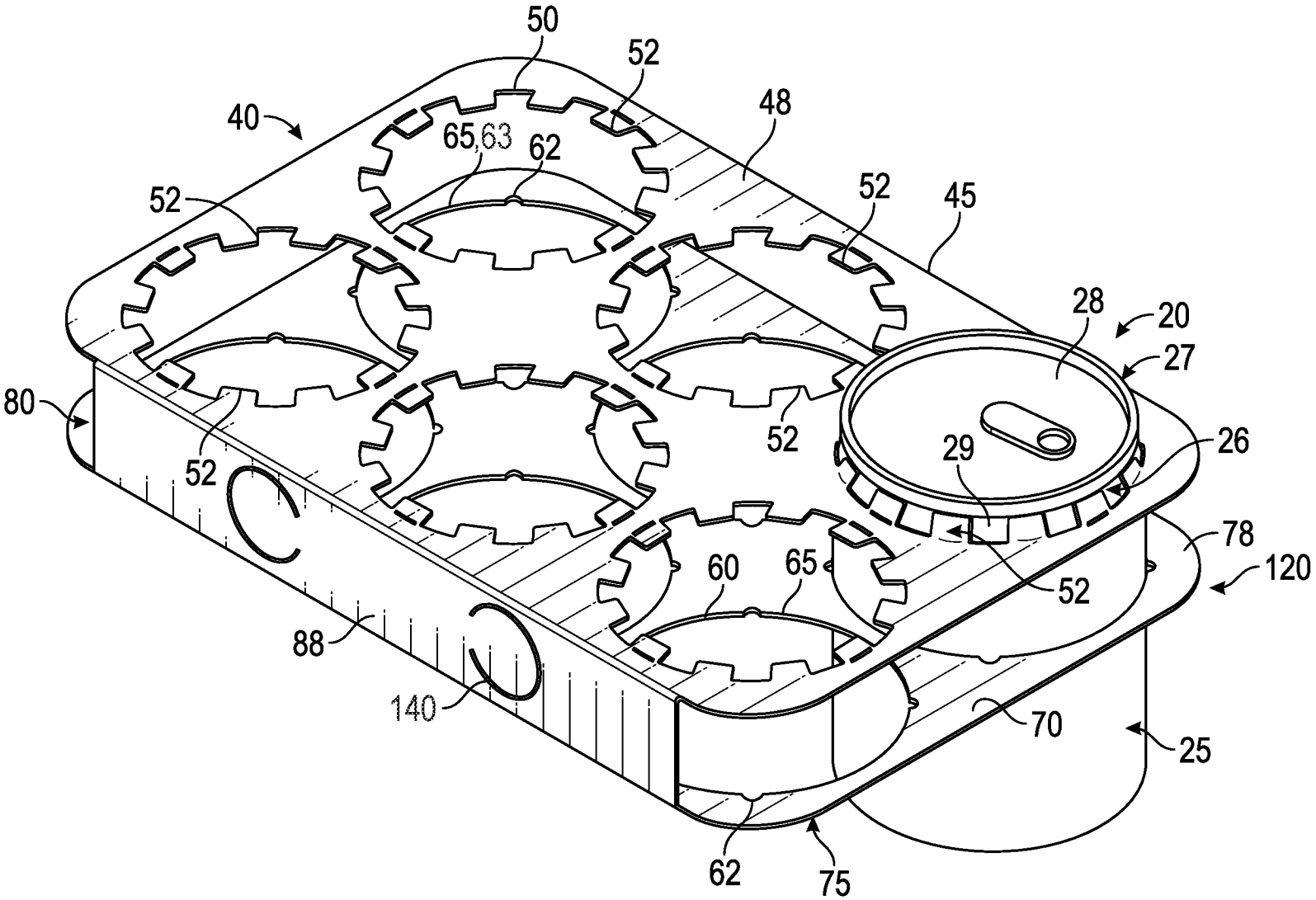
FIG. 1 is a perspective view of one embodiment of the invention.
Figure 2:
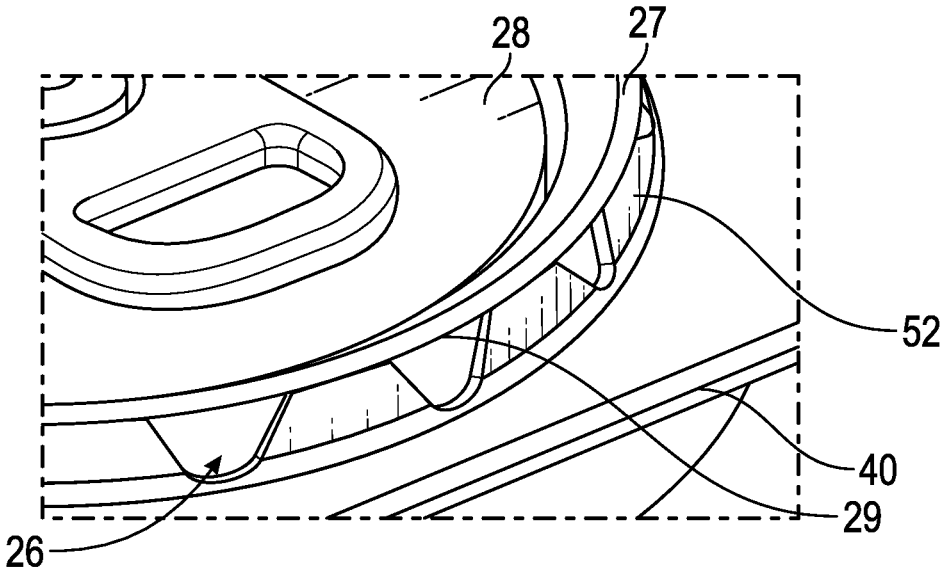
FIG. 2 is a partial, enlarged perspective view of tabs of an upper web aperture in an upper web deformed around a container neck to hold the container.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1-4B illustrate a carrier 10 for a plurality of containers 20 of the type having a body 25, a neck 26, and a lid 28 with a chime 27. The chimes 27 of each container 20 are aligned in a common horizontal plane 30. Such containers 20 may be cans, such as aluminum cans, or other containers 20 as is known in the art.

Figure 3:
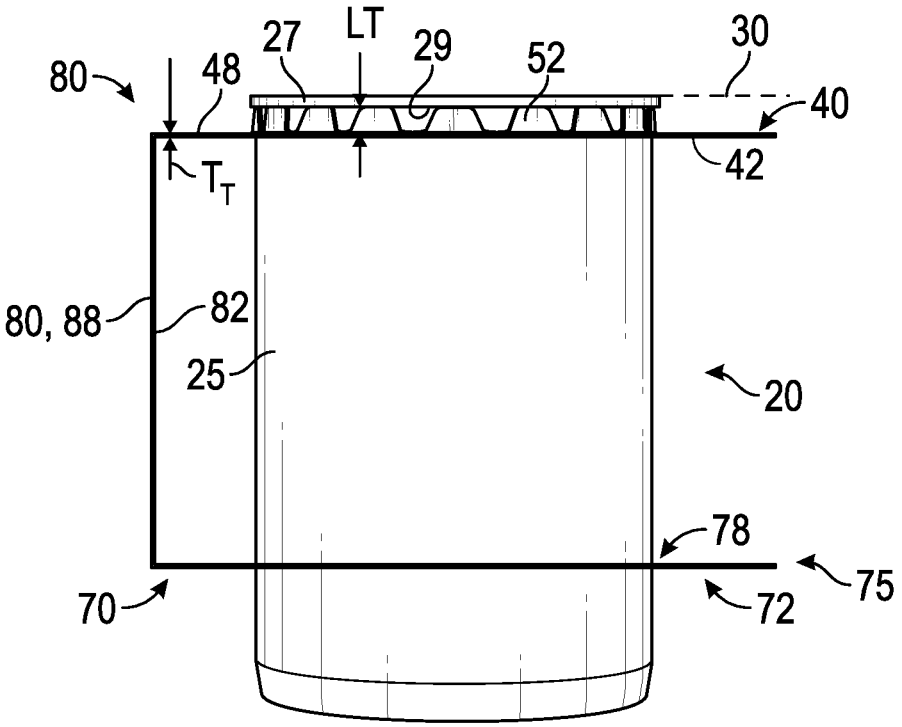
FIG. 3 is a partial a front elevational view of the invention.

An upper web 40 has an upper web top surface 48, an upper web bottom surface 42, at least one upper web peripheral edge 45, and a plurality of upper web apertures 50, each for receiving the chime 27 and the neck 26 of one of the containers 20 therethrough. Each upper web aperture 50 has a plurality of tabs 52 formed at an inside edge 55 thereof. Each tab 52 is configured for bending upward when contacting the chime 27 of one of the containers 20. Each tab 52 has a length $L_T$ and a thickness $T_T$ (FIG. 3).

A lower web 70 has a lower web top surface 78, a lower web bottom surface 72, at least one lower web peripheral edge 75, and a plurality of lower web apertures 60, each for receiving the body 25 of one of the containers 20 therethrough.

A side web 80 connects the upper web 40 with the lower web 70 between at least one each of the upper web peripheral edges 45 and the lower web peripheral edges 75. The side web 80 includes an outer surface 88, an inner surface 82, and at least one side web peripheral edge 85.

Preferably, the upper web 40, side web 80, and lower web 70 are made with a paper board, cardstock, or other easily recycled material. The upper web 40, lower web 70, and side web 80 may all be formed from a common flat cardstock material (FIGS. 1-5), or may be formed into two portions (FIGS. 6-9A) that are adhered or otherwise mutually attached as discussed below. In some embodiments, either the upper web 40 or the side web 80 include finger hole cuts 140 to allow a pack 130 of the containers 20, held together by the carrier 10, to be easily held manually.

As such, with the containers 20 aligned with the lower web apertures 60 of the lower web 70, the carrier 10 is formed into a C-shape 120 and the lower web 70 is pressed onto the containers 20 uniformly so that one container 20 traverses each lower web aperture 60. Each lower web aperture thereby engages the body 25 of one of the containers 20.

Next, the upper web 40 is pressed onto the containers 20 uniformly, the tabs 52 of each of the upper web apertures 50 of the carrier 10 deforming upwardly substantially simultaneously to pass the chimes 27 of the containers 20. Each tab 52 abuts a lower edge 29 of the chime 27 of one of the containers 20 and engages the neck 26 of the container 20. The upper web 40 and the lower web 70 thereby hold each container 20 at the body 25, the neck 26, and the chime 27 thereof.

In preferred embodiments, each lower aperture 60 includes a plurality of notches 62 formed on an inside circumferential edge 63 of the aperture 60. A plurality of lower web aperture tabs 65 are defined between the notches 62. The lower web apertures 60 are sized to snuggly fit around the body 25 of the container 20, with the lower web aperture tabs 65 being slightly deformed or bent to receive each container 20. In some embodiments, each lower web aperture 60 has an even number of notches 62 and an even number of lower web aperture tabs 65. A first diameter $D_1$ between a first pair 66 (FIGS. 9A and 9B) of opposing lower web aperture tabs 65 is less than a second diameter $D_2$ between a second pair 67 of adjacent opposing lower web aperture tabs 65. As such, the first pair 66 of opposing lower web aperture tabs 65 bends or deforms more around the container body 25 than the second pair 67 of adjacent opposing lower web aperture tabs 65. In this manner the carrier 10 can accommodate containers 20 of differing diameters and still maintain a snug hold on the body 25 of the containers at the lower web 70.

Figure 6:
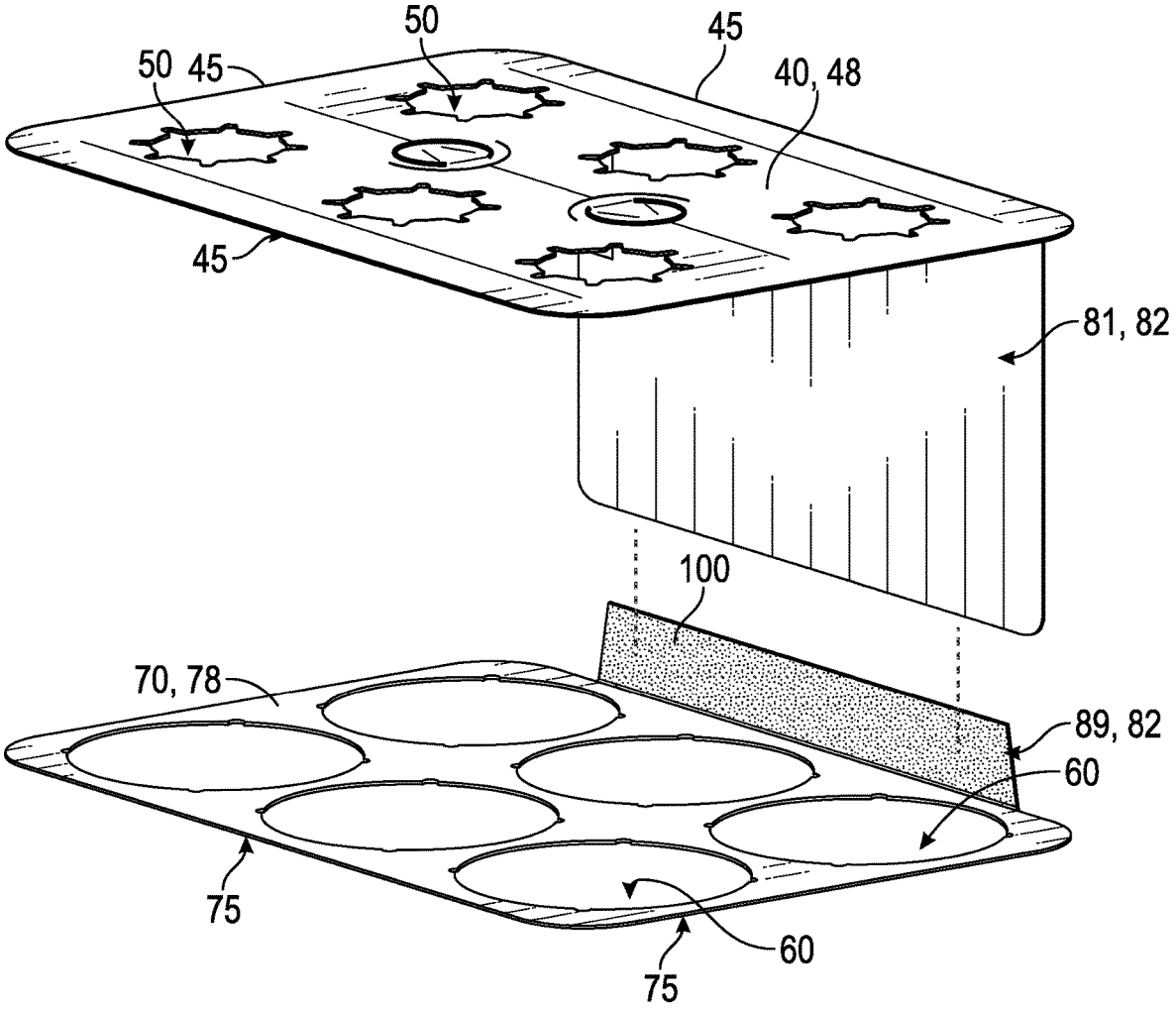
FIG. 6 is an exploded perspective view of an alternate embodiment of the invention.
Figure 7:
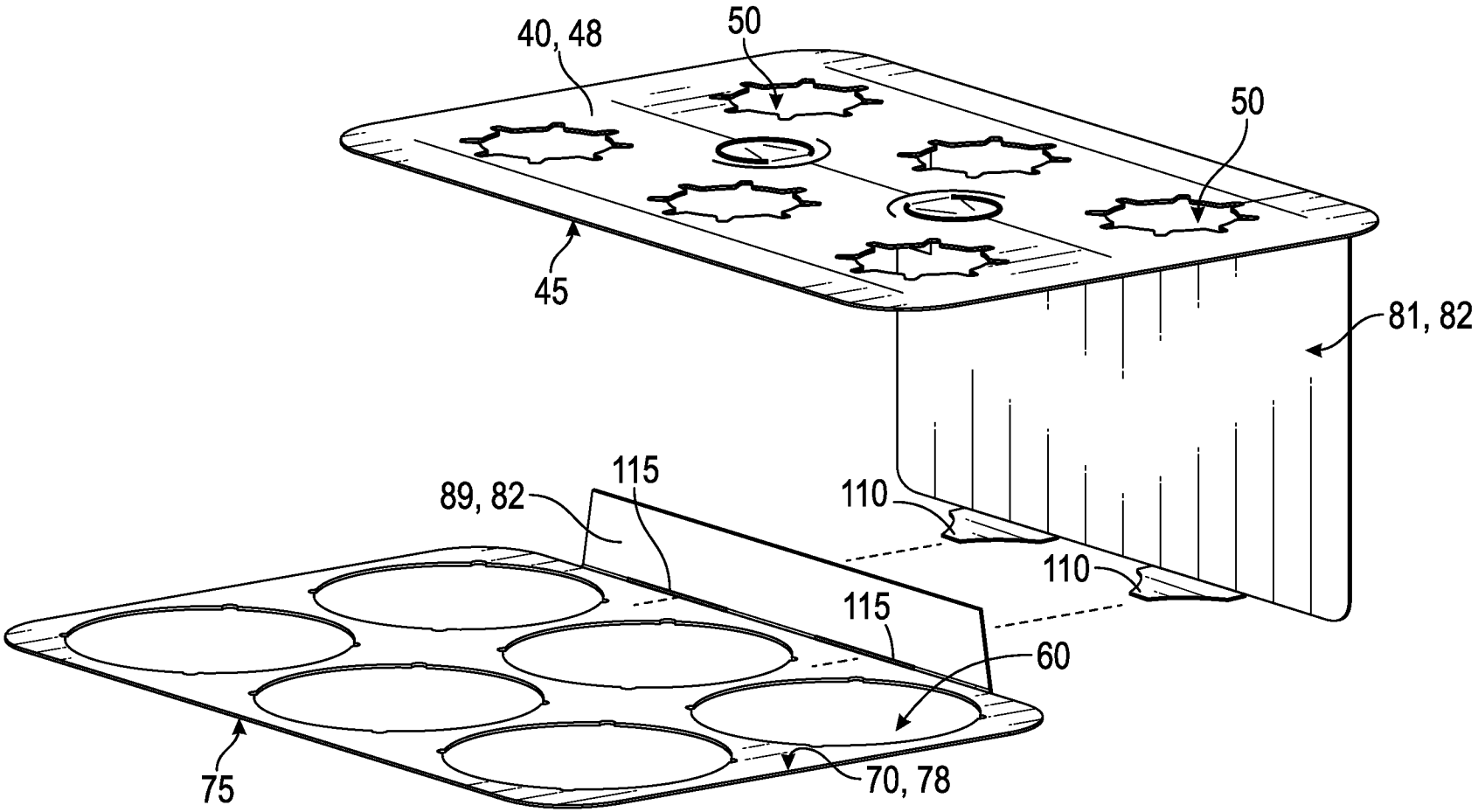
FIG. 7 is an exploded perspective view of another alternate embodiment of the invention.
Figure 8:
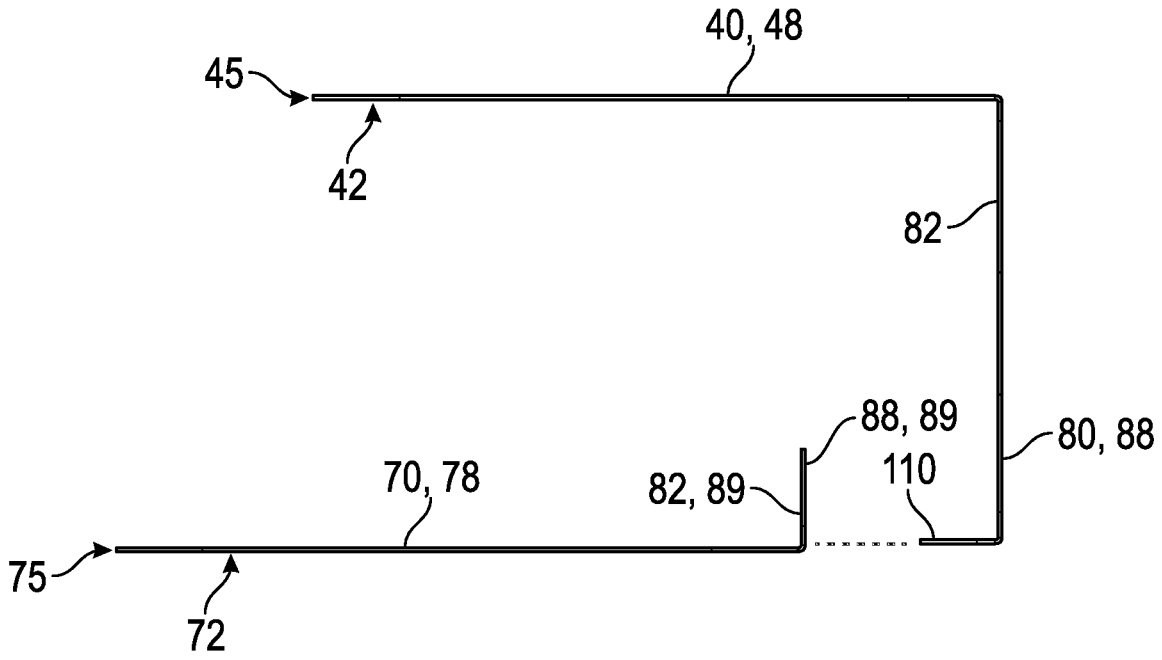
FIG. 8 is a side elevational view of the embodiment of FIG. 7, showing an embodiment for holding bottle-type containers.
Figure 9A:
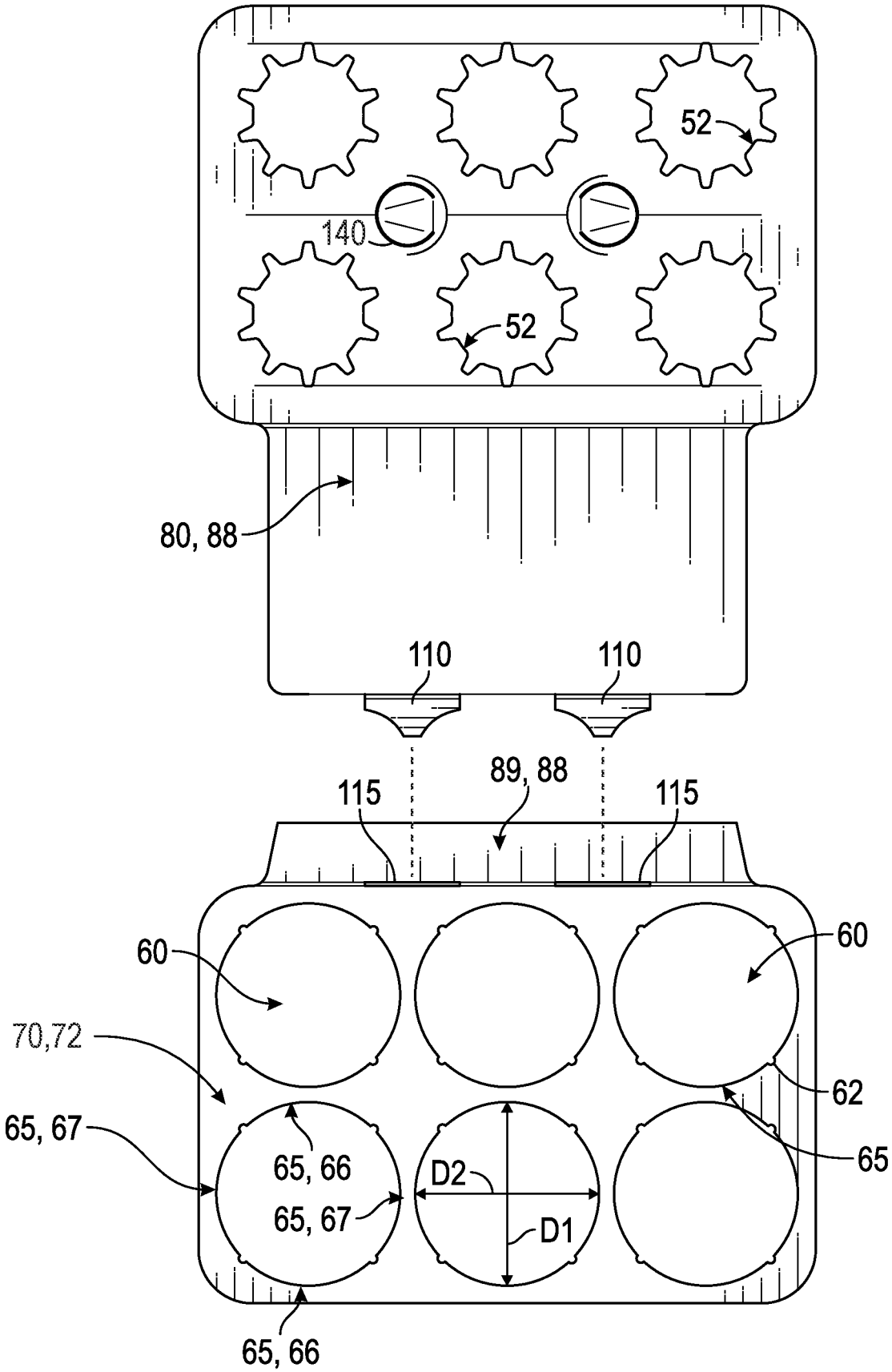
FIG. 9A is a top plan view of the embodiment of FIG. 7, shown in a flat configuration.
Figure 9B:
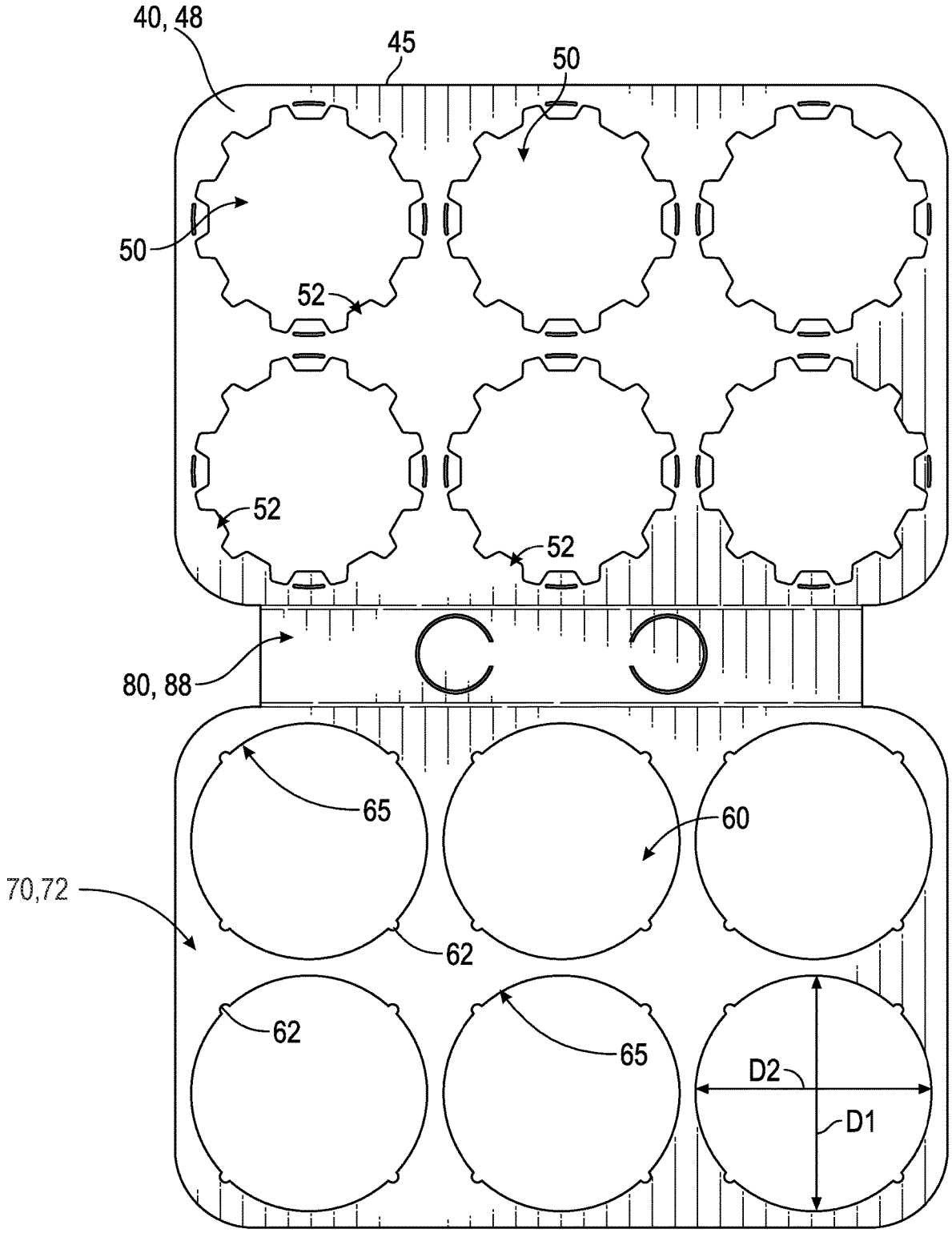
FIG. 9B is a top plan view of the embodiment of FIG. 1 for holding can-type containers, illustrated in a flat configuration.

In some embodiments the side web 80 is comprised of an upper side web 81 fixed with the upper web 40, and a lower side web 89 fixed with the lower web 70. The upper side web 81 and the lower side web 89 are mutually attachable, such as with adhesive 100 (FIG. 6). Alternately, the upper side web 81 includes at least one connection tab 110 and the lower side web 89 includes at least one cooperative slot 115, such that with the lower web 70 and the upper web 40 each fixed about the containers 20, each connection tab 110 may be inserted into one of the at least one slots 115 to mutually fix the upper side web 81 with the lower side web 89. Alternately, the connection tabs 110 may be fixed with the lower side web 89, and the cooperative slots 115 may be formed in the upper side web 81. Preferably such embodiments include two of the connection tabs 110 and two of the cooperative slots 115.

In such embodiments having the upper side web 81 and the lower side web 89, in use the lower web 70 is pressed onto the containers 20 uniformly so that one container 20 traverses each lower web aperture 60. Each lower web aperture thereby engages the body 25 of one of the containers 20.

Next, the upper web 40 is pressed onto the containers 20 uniformly, the tabs 52 of each of the upper web apertures 50 of the carrier 10 deforming upwardly substantially simultaneously to pass the chimes 27 of the containers 20. Each tab 52 abuts a lower edge 29 of the chime 27 of one of the containers 20 and engages the neck 26 of the container 20.

Figure 4A:
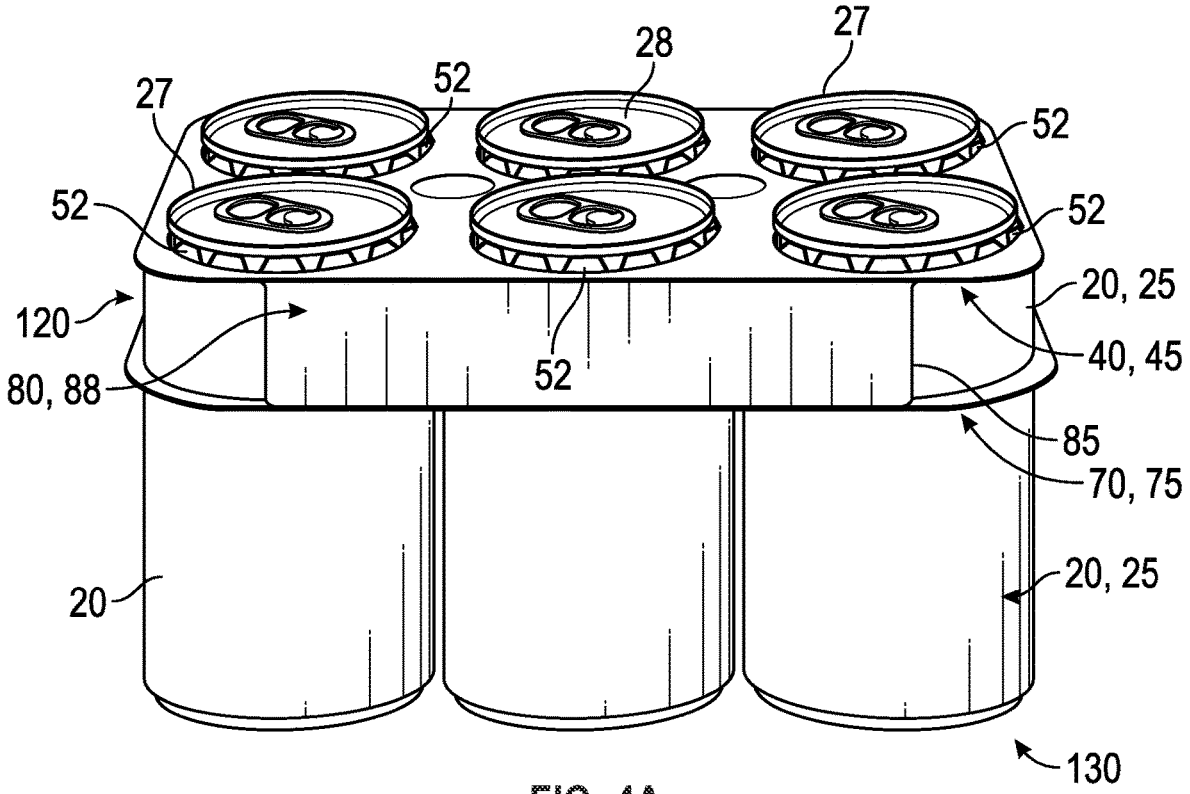
FIG. 4A is a front perspective view of an alternate embodiment of the invention, illustrated with a plurality of containers having a wide profile.
Figure 4B:
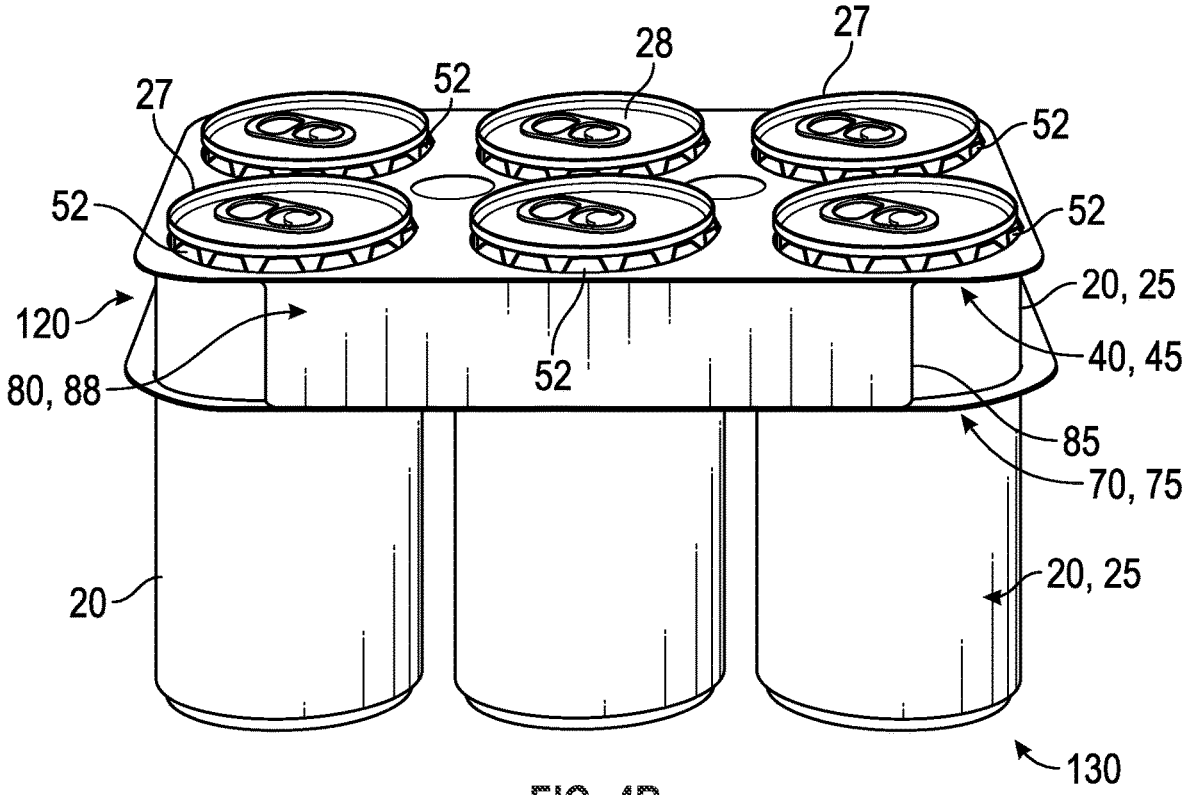
FIG. 4B is a front perspective view of the embodiment of FIG. 4A, but illustrated with a plurality of containers having a slim profile.
Figure 5:
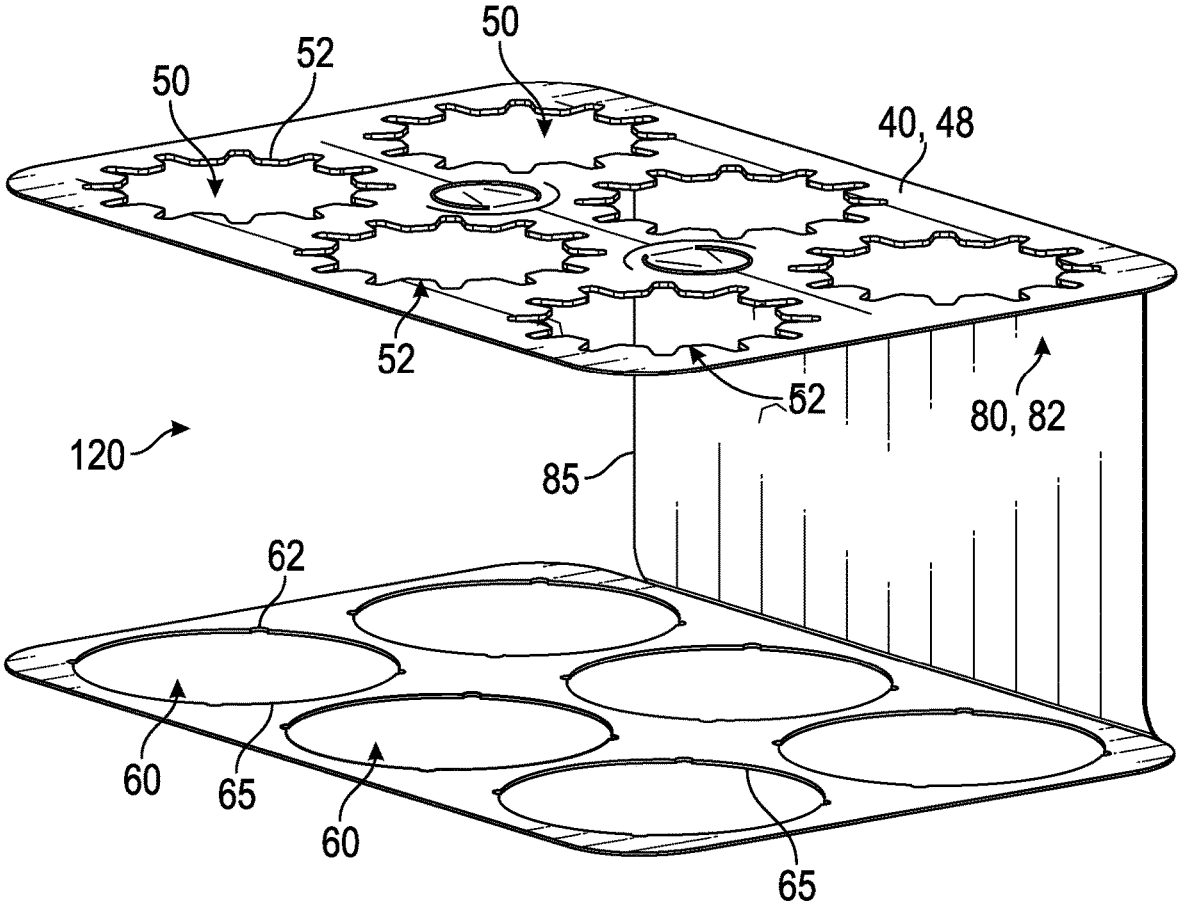
FIG. 5 is a rear perspective view thereof.

Next, the upper side web 81 and the lower side web 89 are mutually affixed, either with the adhesive 100, the connection tabs 110 and the slots 115, or with other mechanical fasteners such that the upper web 40 and the lower web 70 hold each container 20 at the body 25, the neck 26, and the chime 27 thereof. In some embodiments the inner surface 82 of the side web 80 is adhered to the body 25 of at least two of the containers 20 to further hold the containers 20 in the stable, coherent pack 130 (FIGS. 4A and 4B).

While a particular form of the invention has been illustrated and described, it will be apparent that various modifications can be made without departing from the spirit and scope of the invention. For example, carriers for 6-packs of the containers 20 are shown in the drawings, but other configurations can be made, such as for two, three, four, eight, ten, or twelve containers, for example. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A carrier for a plurality of containers of the type having a body, a neck, and a lid with a chime, the chimes of the container all aligned in a common horizontal plane, the carrier comprising:

an upper web having an upper web top surface, an upper web bottom surface, at least one upper web peripheral edge, and a plurality of upper web aperture each for receiving the chime and neck of one of the containers therethrough, each upper web aperture having a plurality of tabs formed at an inside edge thereof, each tab configured for bending upward when contacting the chime of one of the containers, each tab having a length and a thickness;

a lower web having a lower web top surface, a lower web bottom surface, at least one lower web peripheral edge, and a plurality of lower web apertures each for receiving the body of one of the containers therethrough; and a side web connecting the upper web with the lower web, the side web including an outer surface, an inner surface, and at least one side web peripheral edge; wherein:

the at least one upper web peripheral edge includes multiple upper linear edge portions, the at least one lower web peripheral edge includes multiple lower linear edge portions, a single one of the multiple upper linear edge portions is connected, via the side web, to a single one of the multiple lower linear edge portions, and the plurality of tabs are formed uniformly about an entirety of the inside edge of the upper web aperture;

whereby with the containers aligned with the lower web apertures of the lower web, the lower web is pressed onto the containers uniformly so that one container traverses each lower web aperture, each lower web aperture engaging the body of one of the containers, and then the upper web is pressed onto the containers uniformly, the tabs of each of the upper web apertures of the carrier deforming upwardly substantially simultaneously to pass the chimes of the containers, each tab abutting a lower edge of the chime of one of the containers and engaging the neck of the container, the upper web and the lower web holding each container at the body, neck and chime.

2. The carrier of claim 1 wherein each lower web aperture includes a plurality of notches formed on an inside circumferential edge of the aperture, a plurality of lower web aperture tabs being defined therebetween.

3. The carrier of claim 2 wherein the lower web apertures are sized to snugly fit around the body of the container, with the lower web aperture tabs slightly deforming to receive each container.

4. The carrier of claim 3 wherein each lower web aperture has an even number of notches and lower web aperture tabs, a first diameter between a first pair of opposing lower web aperture tabs being less than a second diameter between a second pair of adjacent opposing lower web aperture tabs.

5. The carrier of claim 1 wherein the side web is comprised of an upper side web fixed with the upper web and a lower side web fixed with the lower web, the upper side web and the lower side web being mutually attachable.

6. The carrier of claim 5 wherein the upper side web and the lower side web being mutually attached with an adhesive.

7. The carrier of claim 5 wherein the upper side web includes at least one connection tab and the lower side web includes at least one cooperative slot, whereby with the lower web and the upper web each fixed about the containers, each connection tab is inserted into one of the at least one slots to mutually fix the upper side web with the lower side web.

8. The carrier of claim 7 wherein the lower side web includes at least one connection tab and the upper side web includes at least one cooperative slot, whereby with the lower web and the upper web each fixed about the containers, each connection tab is inserted into one of the at least one slots to mutually fix the upper side web with the lower side web.

9. A method of packaging a plurality of containers of the type having a body, a neck, and a lid with a chime, the chimes of the container all aligned in a common horizontal plane, the method comprising the steps:

providing a carrier for a plurality of containers of the type having a body, a neck, and a lid with a chime, the chimes of the container all aligned in a common horizontal plane, the carrier comprising: an upper web having an upper web top surface, an upper web bottom surface, at least one upper web peripheral edge, and a plurality of upper web aperture each for receiving the chime and neck of one of the containers therethrough, each upper web aperture having a plurality of tabs formed at an inside edge thereof, each tab configured for bending upward when contacting the chime of one of the containers, each tab having a length and a thickness; a lower web having a lower web top surface, a lower web bottom surface, at least one lower web peripheral edge, and a plurality of lower web apertures each for receiving the body of one of the containers therethrough; and a side web connecting the upper web with the lower web, the side web including an outer surface, an inner surface, and at least one side web peripheral edge wherein the at least one upper web peripheral edge includes multiple upper linear edge portions, the at least one lower web peripheral edge includes multiple lower linear edge portions, a single one of the multiple upper linear edge portions is connected, via the side web, to a single one of the multiple lower linear edge portions, and the plurality of tabs are formed uniformly about an entirety of the inside edge of the upper web aperture;

aligning the lower web apertures of the lower web with the containers;

pressing the lower web onto the containers uniformly so that one container traverses each lower web aperture, each lower web aperture engaging the body of one of the containers; and pressing the upper web onto the containers uniformly, the tabs of each of the upper web apertures of the carrier deforming upwardly substantially simultaneously to pass the chimes of the containers, each tab abutting a lower edge of the chime of one of the containers and engaging the neck of the container.

10. The method of claim 9 further including the step:

forming the carrier into a C-shape wherein the upper web is mutually aligned and parallel with the lower web.

11. The method of claim 9 further including the steps:

the side web being comprised of an upper side web fixed with the upper web and a lower side web fixed with the lower web; and mutually attaching the upper side web and the lower side web.

12. The method of claim 9 further including the steps:

the side web being comprised of an upper side web fixed with the upper web and a lower side web fixed with the lower web; and mutually attaching the upper side web and the lower side web with an adhesive.

13. The method of claim 9 further including the steps:

the side web being comprised of an upper side web fixed with the upper web and including at least one connection tab, and a lower side web fixed with the lower web that includes at least one cooperative slot; and inserting at least one connection tab into one of the at least one slots to mutually fix the upper side web with the lower side web.

14. The method of claim 9 further including the steps:

the side web being comprised of an upper side web fixed with the upper web and including at least one slot, and a lower side web fixed with the lower web that includes at least one cooperative connection tab; and inserting at least one connection tab into one of the at least one slots to mutually fix the upper side web with the lower side web.

* * * * *